US007628180B1

(12) United States Patent
Golz

(10) Patent No.: US 7,628,180 B1
(45) Date of Patent: Dec. 8, 2009

(54) MOLDABLE WEBBING

(75) Inventor: Robert E. Golz, Swansea, MA (US)

(73) Assignee: Murdock Webbing Company, Inc., Central Falls, RI (US)

( * ) Notice: Subject to any disclaimer, the term of this patent is extended or adjusted under 35 U.S.C. 154(b) by 38 days.

(21) Appl. No.: 11/717,539

(22) Filed: Mar. 13, 2007

Related U.S. Application Data

(60) Provisional application No. 60/781,851, filed on Mar. 13, 2006.

(51) Int. Cl.
*D03D 15/00* (2006.01)
*D03D 11/00* (2006.01)
*D03D 7/00* (2006.01)
*D03D 25/00* (2006.01)

(52) U.S. Cl. ..... 139/409; 139/383 R; 139/420 R; 139/426 R

(58) Field of Classification Search ..... 139/383 R, 139/383 A, 384 R, 387 R, 404–406, 409, 139/410, 413–415, 420 R, 420 A, 426 R
See application file for complete search history.

(56) References Cited

U.S. PATENT DOCUMENTS 3,885,603 A * 5/1975 Slaughter ..... 139/425 A
4,224,372 A * 9/1980 Romanski ..... 442/187
4,600,626 A * 7/1986 Ogata ..... 428/193
5,219,636 A * 6/1993 Golz ..... 428/193
5,419,951 A * 5/1995 Golz ..... 442/200
5,477,891 A 12/1995 Benesi
5,556,696 A * 9/1996 Pinkus ..... 442/150
5,564,476 A * 10/1996 Golz ..... 139/388
5,677,056 A 10/1997 Golz
5,699,836 A 12/1997 Golz
6,242,372 B1 6/2001 Schwekutsch
6,953,064 B2 * 10/2005 Golz ..... 139/383 R
2004/0011418 A1 * 1/2004 Golz ..... 139/383 R

* cited by examiner

*Primary Examiner*—Bobby H Muromoto, Jr.
(74) *Attorney, Agent, or Firm*—Salter & Michaelson

(57) ABSTRACT

A woven fabric that is characterized by retaining its shape once formed and that includes monofilament filling yarns that are disposed in at least two separate plies, ground yarns that weave alternatively over and under respective monofilament yarns, stuffer yarns that extend in the direction between monofilament filling yarns of respective plies and binder yarns that extend between monofilament filling yarns of respective plies. A method forms a woven fabric into a permanent shape.

36 Claims, 5 Drawing Sheets

MOLDABLE WEBBING

RELATED CASES

Priority for this application is hereby claimed under 35 U.S.C. § 119(e) to commonly owned and U.S. Provisional Patent Application No. 60/781,851 which was filed on Mar. 13, 2006 and which is incorporated by reference herein in its entirety.

FIELD OF THE INVENTION

The present invention relates in general to an improved webbing material, particularly one that can be molded or formed into a predetermined shape and has a characteristic of being retained in that shape. The present invention also pertains to a method of forming a woven fabric so that it can be molded into a permanent predetermined form or shape. The present invention is considered as having a multitude of possible applications, such as in the fall protection industry, for recreational products, in the medical field, the apparel industry, for the military and possibly for home land security applications.

BACKGROUND OF THE INVENTION

Narrow fabric webbing may be defined as any woven, braided or knitted textile product that, in general, is less than 12 inches in width, but may also be wider such as 18 inches in width. These narrow fabric structures can be fabricated using spun textile yarns made from natural fibers and or synthetically manufactured fibers in continuous filament form.

Traditionally the majority of woven narrow fabric products are comprised of the same class of fiber such as a 100% cotton structure as used in the manufacture of belts for apparel or 100% continuous filament polyester such as is used in automobile seat belt applications. The selection of materials is based on the particular requirements and end use of the finished product. Generally, if a soft flexible finished narrow fabric product is desired, spun or textured yarns are selected as the primary substrate. Similarly, in a seat belt application low elongation, high strength and a light weight fabric are desirable physical properties, thus continuous filament polyester is a desirable substrate. If thermal properties are desired the fiber choice may be selected from the "aramid" class of synthetic fibers.

To further enhance the desired physical properties or hand characteristics of a woven narrow fabric one must give equal consideration to the type of weave and density of the fabric. Typically woven narrow fabric weaves are selected but not limited to the traditional class of weaves such as plain weave, twill weave, satin weave, double plain weave, stuffer weaves, etc. Denser weave constructions may be used to increase the breaking strength of a woven narrow fabric.

Currently there are no narrow fabrics that are available on the market using any of the above mentioned constructions, densities or combination of yarns that allow woven narrow fabric webbing to be formed so as to retain a selected shape. As a matter of fact there is also no such fabric available whether for narrow fabric applications or for wider fabric applications.

It is, therefore, very desirable and would have commercial value to develop a narrow fabric webbing that is able to retain it shape when formed. The present invention addresses this matter.

SUMMARY OF THE INVENTION

To accomplish the foregoing and other advantages the present invention is embodied in a woven fabric that is characterized by retaining its shape once formed. The woven fabric comprises mono-filament filling yarns that are disposed in at least two separate plies; ground yarns that weave alternatively over and under respective mono-filament filling yarns; stuffer yarns that extend in a direction between mono-filament filling yarns of respective plies and binder yarns that extend between mono-filament filling yarns of respective plies.

Other aspects of the present invention include the mono-filament filling yarns may comprise a continuous single spun mono-filament; mono-filament filling yarns are selected from the group that includes nylon, polyester and polypropylene; the mono-filament filling yarn may have a yarn size in a range between 14 and 10,000 denier; the density of the mono-filament filling yarn may be in a range of 5-100 yarns per inch or more preferably 10-20 yarns per inch; the stuffer yarns are also mono-filament yarns so as to enable shape retention in both warp and weft directions; the mono-filament filling yarns may have a diameter of at least 0.002 inch; and ground and binder yarns may be a 20/2 spun polyester.

In accordance with another feature of the present invention there is provided a method of forming a woven fabric into a predetermined shape, comprising the steps of: providing a woven fabric that includes a mono-filament filling yarn that is disposed in separate plies; weaving a ground yarn alternatively over and under respective mono-filament filling yarns; forming the fabric into the predetermined shape; and applying heat to the thus formed fabric at a temperature of at least 150° F. for at least 5 minutes, but depending on the particular type of monofilament yarn that is used.

In accordance with further aspects of the present invention the monofilament yarns may be from a class of manmade synthetic yarns; the warp yarns may have a minimum yarn size of 50,000 yards per pound; the binder yarns may have a minimum yarn size of 50,000 yards per pound; the picks across the width may have a range of 5 per linear inch to 100 per linear inch; the minimum density of the monofilament filling yarn may be between 5 picks per linear inch using a monofilament yarn having a yarn size of 14 denier up to 100 picks per inch using a monofilament yarn having a yarn size of 10,000 denier; and the warp yarns may have a minimum density of 144 ends per inch having a minimum yarn size of 50,000 yards per inch.

DESCRIPTION OF THE DRAWINGS

Numerous other features and advantages of the present invention are realized upon a reading of the detailed description that follows when taken in conjunction with the accompanying drawings, in which.

DETAILED DESCRIPTION

Figure 1A:
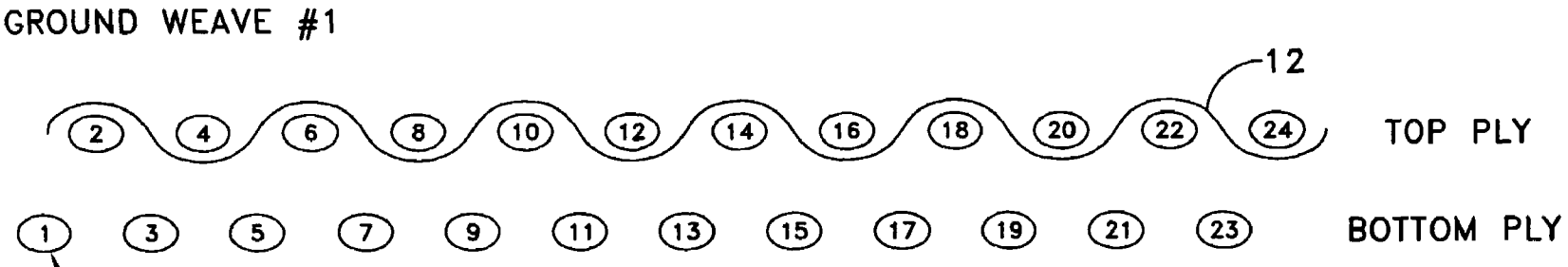
FIGS. 1A-1G illustrate the ground weaves, stuffer yarns and binder yarns as related to the mono-filament filling yarns used in fabricating a fabric in accordance with the present invention.
Figure 1B:
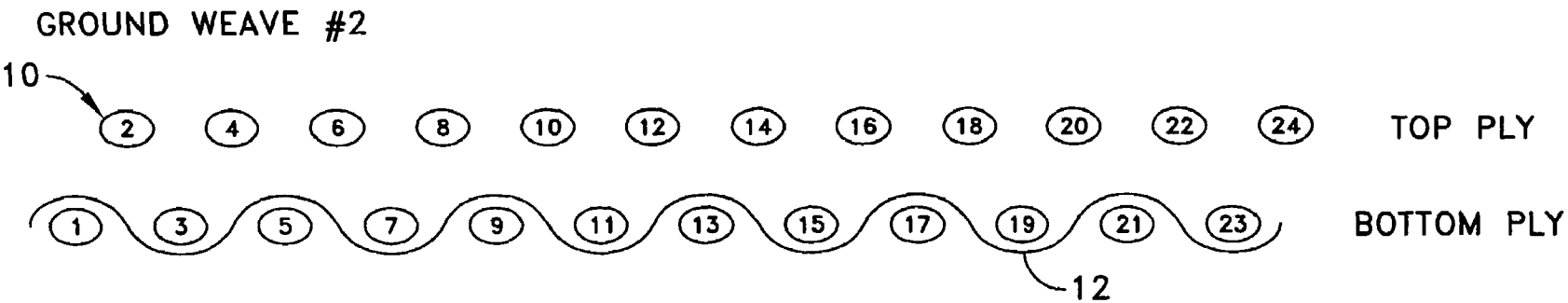
Figure 1C:
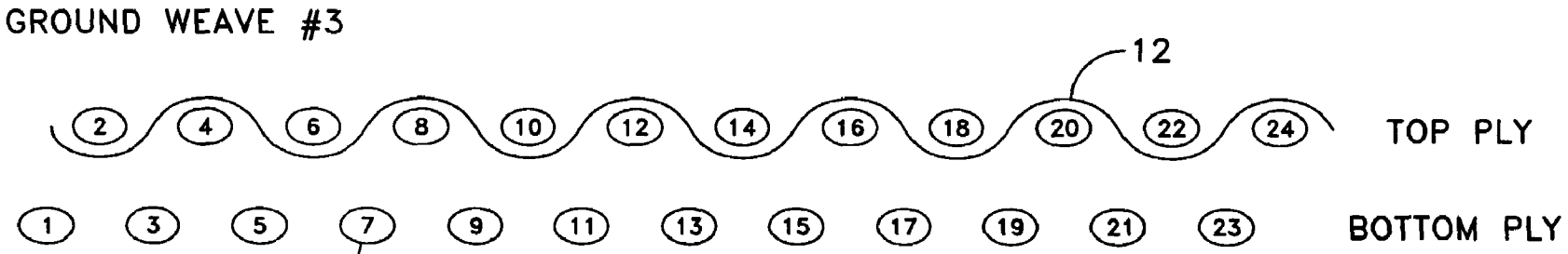
Figure 1D:
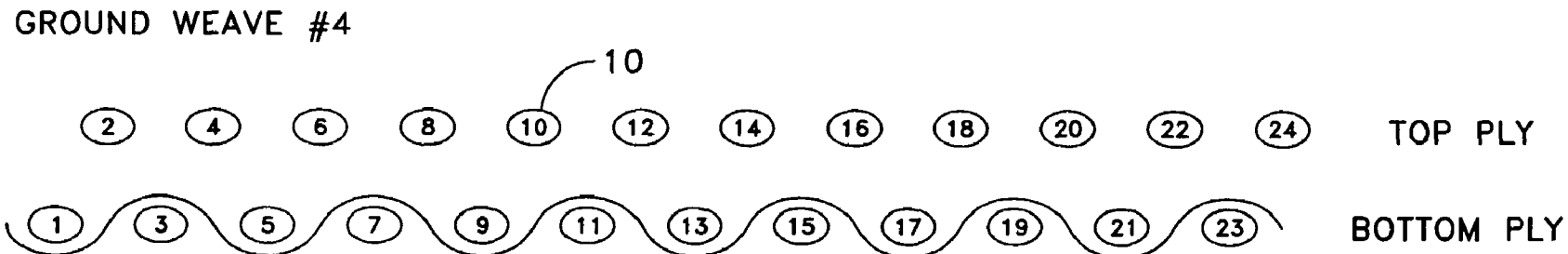

The fabric of the present invention is capable of retaining its shape when it is molded into virtually any shape or configuration. The fabric may be formed around an object or series of objects in order to define a particular shape. For example, the fabric may be pre-formed by hand into an "S" or "L" configuration for such applications where multiple shapes are desired. A heat cycle may be used to maintain the molded fabric into a more or less permanent form.

Narrow and other fabrics are manufactured using various weave configurations. Weave configurations used in the fabric industry are comprised of, but not limited to the following types of weaves.

Plain weave 3 up 1 down twill 3 up 1 down 1 up 3 down twill

Plain tubular weave 2 up 2 down tubular weave 3 up 1 down tubular weave 5 up 1 down 1 up 5 down with or without binder yarns 7 up 1 down 1 up 7 down with or without binder yarns Double plain weave with 1 up 1 down binder sequence Double plain weave with 2 up 2 down binder sequence Double plain weave with 1 up 1 down binder and stuffers Double plain weave with 2 up 2 down binder and stuffers Self-interlocking 12 pick repeat Self-interlocking 14 pick repeat Three ply—face middle back with 3 up 3 down binders Three ply—face middle back with 2 up 2 down binders Double wall tubular with connected edges Slotted weave 2 up 1 down 1 up 2 down twill with binders and stuffers 4 ply plain weave 4 ply self-interlocking The above weave configurations may consist of yarns of various sizes and types. There are yarns that weave in the length wise direction, parallel to the edges and a yarn or yarns which weave across the width of the webbing from edge to edge. The yarns that weave in the length wise direction are usually referred to as warp or ground yarns and the yarns which weave across the width of the webbing are referred to as filling yarns, weft yarn or picks.

Figure 3:
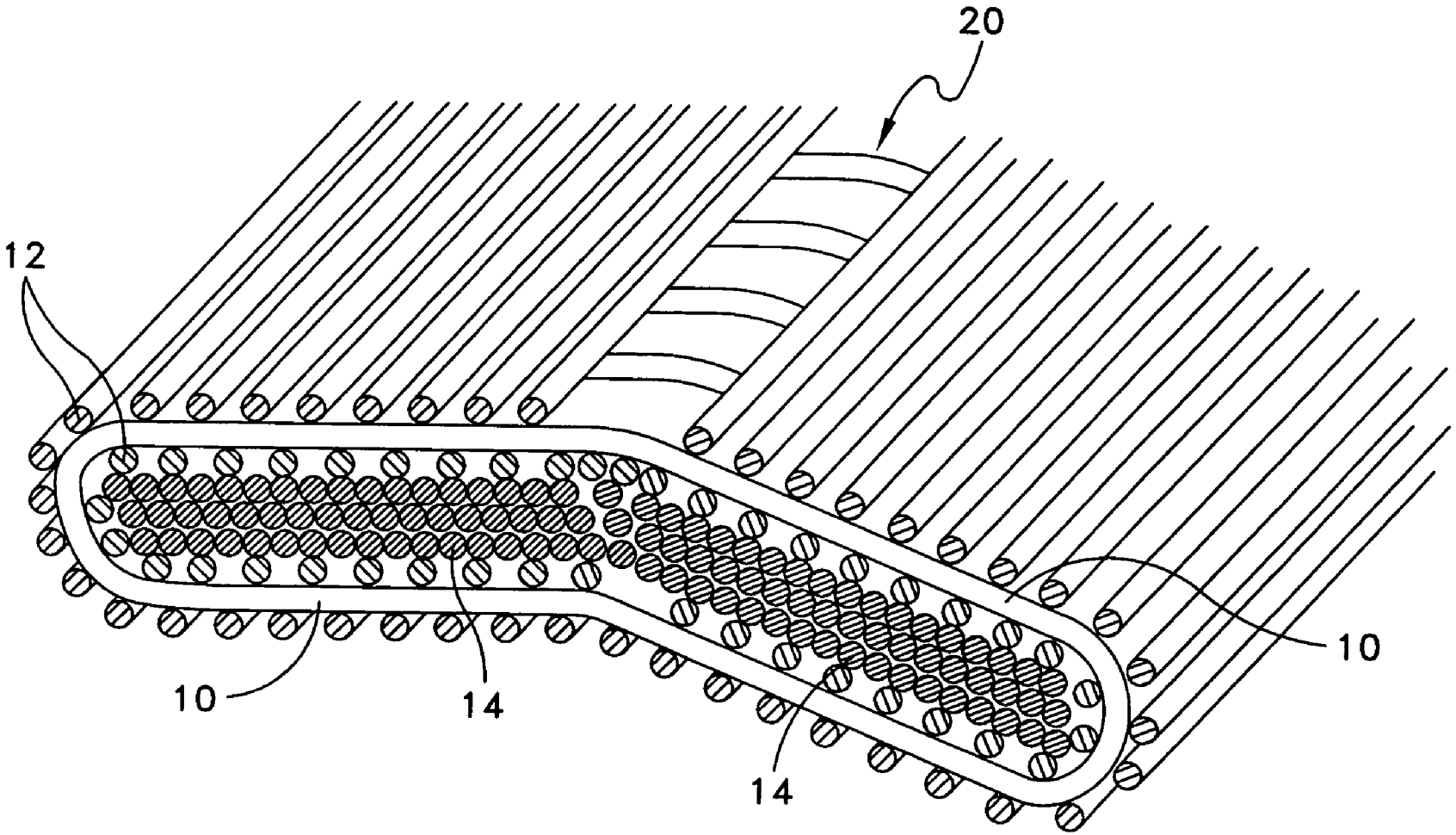
FIG. 3 shows the same perspective view as in FIG. 2 but illustrating the manner in which the ground yarns are able to slide over the mono-filament yarns to retain fabric shape.

The present invention is based, in one embodiment thereof, on the webbing being able to be folded in the filling direction, such as that illustrated in FIG. 3 herein. The density of a narrow fabric is determined by the number and size of warp and filling ends per given length of webbing. Denser webbing has been found to have better ability to retain its shape when folded than webbing that is less dense. However, to provide shape retention it has been found in accordance with the present invention that a mono-filament fiber is to be used for the filling yarns. Alternatively, if the bending is desired in the orthogonal direction then the ground or stuffer yarns are mono-filament.

Thus, in a preferred embodiment the present invention is directed to a webbing that uses a mono-filament yarn in the filling direction. The mono-filament yarn is a single filament of a manufactured fiber, usually of a denier of at least 14. Instead of a group of filaments being extruded through a spinneret to form a yarn, mono-filaments are generally extruded individually. The mono-filament yarn may come from the class of manufactured fibers of nylon, polyester, polypropylene or any such fiber than exhibits the characteristics to allow the webbing to be molded.

The principles behind a narrow fabric being able to be molded are basically two fold. The first being the use of a mono-filament filling yarn and the second is the density of the fabric itself, particularly the density of the pick count. The preferred weave design for this invention is a double plain weave with 1 up 1 down binder and stuffers. However, any one of the previously listed weaves or other weaves may be used in practicing the principles of the present invention. A mono-filament yarn has greater stiffness than a multifilament yarn of equal size. In this preferred weave design the filling yarn (weaves from edge to edge) is inserted by either a weft needle as in a needle loom or by a shuttle as would be used in a shuttle type loom. The loom is programmed so as to insert the first filling yarn (pick) 10 on the bottom ply of the 2 ply weave. The next filling yarn 10 is inserted on the top ply of the 2 ply weave. The filling yarn alternates from bottom to top for each pick. Numbering the sequence of picks, as illustrated in FIGS. 1A-1G, shows all the odd numbered picks lie on the back of the webbing and all the even numbered picks lie on the face of the webbing, or visa versa if the first filling yarn is inserted on the face of the webbing. See FIG. 1A to 1D and the numbered picks 1-24.

Figure 1E:
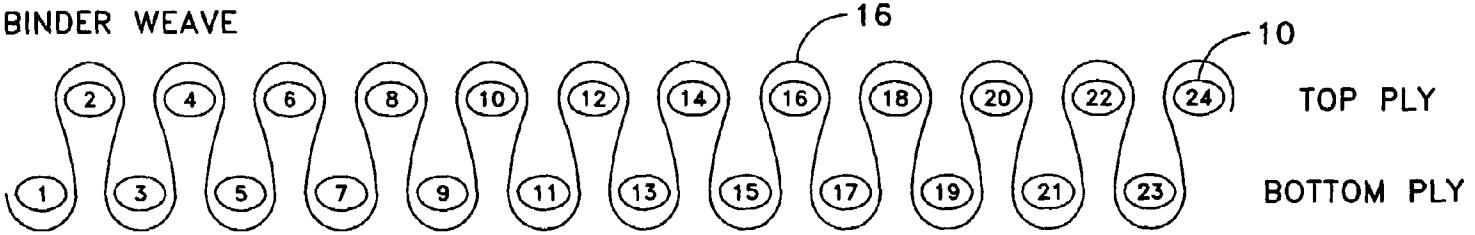
Figure 1F:
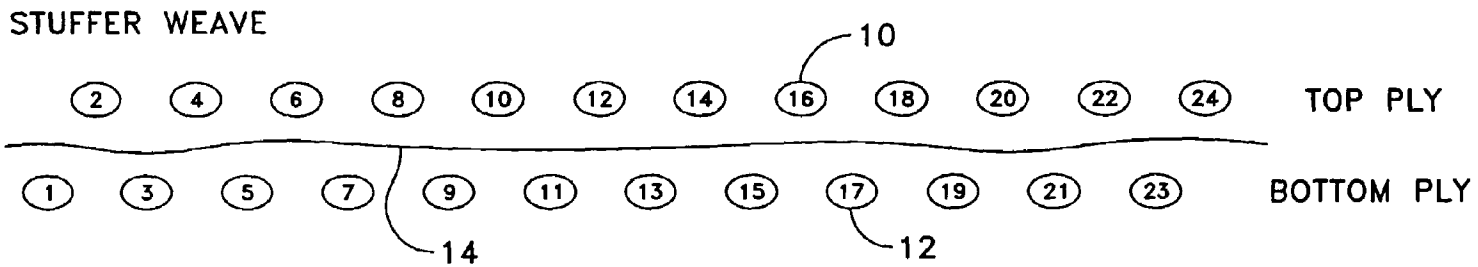
Figure 1G:
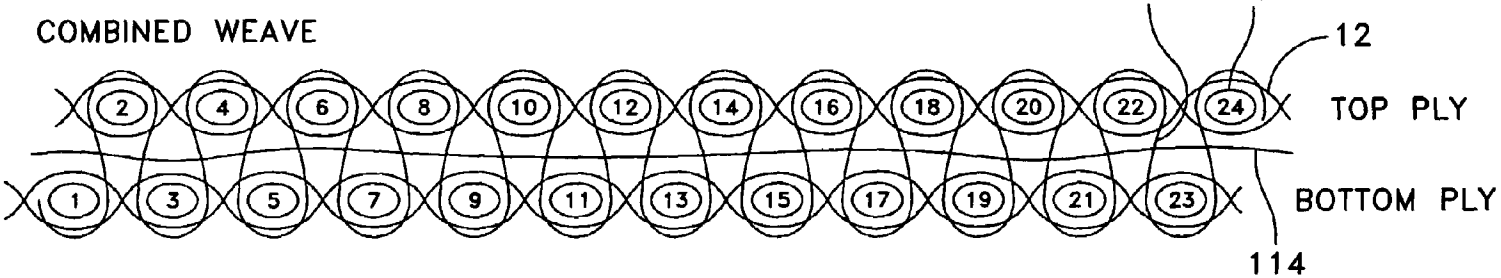

One half of the ground ends 12 weave on the top ply of the webbing and the other half weave on the bottom ply of the webbing. The stuffer yarns 14 weave under the filling yarns 10 that weave on the top ply and over the filling yarns that weave on the bottom ply. Lastly, the binder yarns 16 have a 1 up 1 down weave configuration as shown in FIG. 1E. These binder yarns 16 lock the double plain 2 ply construction together and contribute to the retention feature of the present invention. This weaving sequence includes first weaving under filling yarn number "1" and over filling yarn number "2", under "3", over "4" and so on. This binds all the components together. Refer to FIG. 1.

The preferred embodiment for the ground and binder yarns is a 20/2 spun polyester. Since the stuffer yarns 14 do not actually weave, they just lie between the top and bottom ply, the preferred embodiment for the yarns 14 can be either spun polyester or continuous filament yarns. Lastly, the mono-filament filling yarn 10 preferred embodiment has a yarn size between 14 denier and 10,000 denier.

Figure 2:
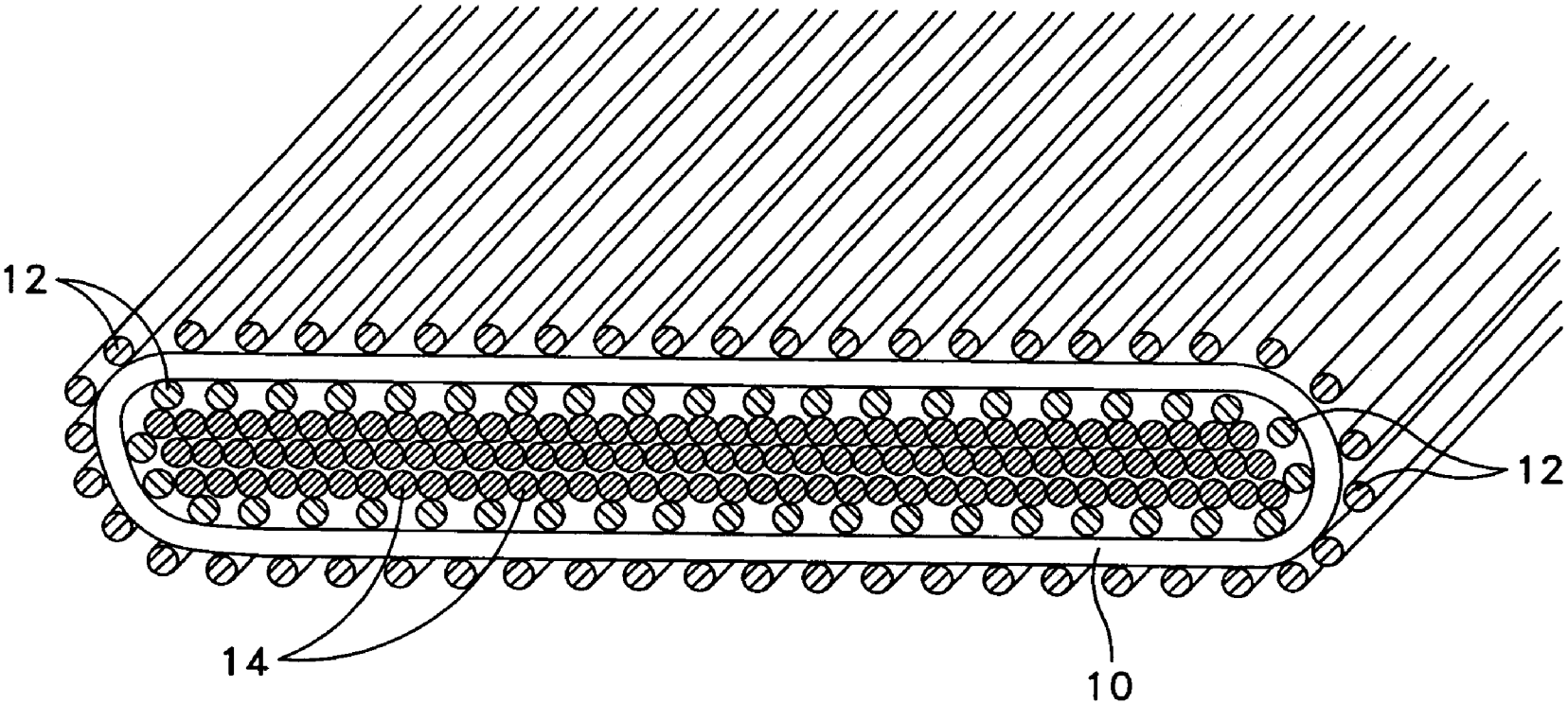
FIG. 2 is a perspective view that illustrates the relationship between the various yarns for a double plain weave with 1 up 1 down binder and stuffers.

It is theorized that the reason this invention has moldable properties is because of the propensity of the ground yarns to be able to slide over the mono-filament filling yarns. This occurs when the fabric is bent in the filling direction, such a shown in FIG. 3 at 20. Although the ground ends slide over the filling yarns when bent in the filling direction, there is not enough recovery forces in the filling yarns to allow the ground ends to slip back into their original position, thus the webbing keeps its shape. By making the construction denser, particularly the density of the filling yarns, the moldability is increased. The fabric retains its shape until a force that exceeds the bending force of the filling yarn is applied to the fabric. When a force that exceeds the bending force of the mono-filament filling yarn is applied to the fabric, the ground yarns return to their original position and the fabric returns to its original shape. The mono-filament filling yarn 10 because of its high stiffness properties lies flat and straight across the width of the fabric allowing for slippage of the ground ends 12. The filling yarn does not weave around the ground ends in the weaving operation, the ground ends weave around the filling yarns. See FIGS. 2 and 3.

It is also possible to use the same theory to mold the webbing in the opposite direction. The principal is that the non-mono-filament yarns be able to slide over the mono-filament yarns. To have moldable properties in the warp direction one would change the stuffer yarn type from spun or continuous filament to the stiffer mono-filament yarns. Density would again play an important role. A denser mono-filament construction for the stuffer weave, the stiffer and more moldable the fabric is in the warp direction. Combinations of densities in both stuffer and filling directions allows a fabric to be built that possesses more moldable characteristics in the filling and less in the warp direction or better moldable properties in the warp direction and less in the filling direction. The possibilities are limitless depending on the end item use.

Trials have been performed on a Murdock Webbing Part Number 1198, 5½" webbing varying the ambient temperatures to see how and what physical properties might be influenced. The first trial was to subject the webbing to 150° F. temperatures for a couple of hours. The webbing with polyester monofilament filling did not loose its moldable properties while at 150° F. When brought back to room temperature the product retained all of its original physical and moldable properties.

Heat on the other hand has quite a different effect on the product. A great deal of textile products are woven with natural yarns and then exposed to a secondary process to affix the color. These processes normally expose the webbing to some type of dyestuff in an aqueous solution, then dried at elevated temperatures between 200-325° F. for varying amounts of time.

The trials that were conducted showed that all moldable properties were lost when the webbing was exposed to temperatures in the 225° F. range or higher. Thus, if color is to be added to this moldable webbing during the fabrication process, one has to use pre-dyed yarns or air dry the product at ambient temperature.

Additional trials were run to find out at what point on the temperature line did the webbing began to loose its moldable properties. The first trial was to expose the product to temperatures of 150 to 200° F. at 10 degree increments for one hour. Under these conditions the webbing did not loose moldability. However at 200° F. for 8 hours the webbing did loose substantially all of its moldability.

Another trial was run to see if heat could be used to permanently mold the fabric product. In one test using nylon or polyester filler yarns the moldable webbing was wrapped around an object, tied in place and the core and webbing was exposed to 250° F. for at least 5 minutes. When the core was removed the webbing retained the shape of the core and could not be brought back to its original flat shape. In another example, using polypropylene for the filler yarns it was found that the product could be permanently molded by the application of a temperature of at least a 150° F. for at least 5 minutes. In either of the above examples, it is preferred that the subjected temperatures be exposed for greater than 5 minutes, perhaps as long as 4-8 hours.

Samples of a 2 inch wide narrow fabric were made using the following construction:

| | |
|---|---|
| Weave: | Double Plain with 1 up and 1 down binder sequence |
| Ground ends: | 288 ends 20/2 spun polyester |
| Binder ends | 35 ends 20/2 spun polyester |
| Stuffer ends | 170 ends 1000/2 continuous filament polyester |
| Stuffer ends | 72 ends 2150 denier mono-filament polyester |
| Filling Yarn | 17.5 picks of 2150 denier monofilament polyester filling (2 picks per shed). |

The density of the filling yarn was calculated. The formula used was the total picks per inch times the denier of the filling yarn is:

17.5 picks per inch×2 picks per shed×2150 denier=75,250 total denier.

A method was developed to determine the force required to bend this webbing in the filling direction. The test involved taking the 2" wide sample, placing it in a set of 3" wide flat faced clamps in a vertical position and clamping it in position with 1½" exposed over the top of the clamp. Next the 3" of webbing was bent in the filling direction at a 15 degree angle from vertical. The load was applied from the top clamp compressing the webbing in the bottom clamp with a speed of 1 inch per minute. The load was recorded when the top clamp compressed the webbing in the bottom clamp by 1 inch.

Additional samples were made reducing the pick count (density) of the filling yarn and the same test method applied to the less dense webbing to show the effect of density on the force required to bend or mold the webbing in the filling direction. The table below illustrated the relationship between filling density and bending force.

| | |
|---|---|
| Trial #1 | 17.5 picks per inch 2150 filling = 75,250 total denier = 9.86 pounds force at a 1" deflection. |
| Trial #2 | 16.0 picks per inch 2150 filling = 68,800 total denier = 7.50 pounds force at a 1" deflection. |
| Trial #3 | 14.0 picks per inch 2150 filling = 60,200 total denier = 5.69 pounds force at a 1" deflection. |
| Trial #4 | 12.0 picks per inch 2150 filling = 51,600 total denier = 3.67 pounds force at a 1" deflection. |
| Trial #5 | 10.0 picks per inch 2150 filling = 43,000 total denier = 1.54 pounds force at a 1" deflection. |

The same type testing was done on the above sample but in the warp direction. The construction of the webbing is the same as in trial #5 with the exception of the addition of the mono-filament stuffer ends. The first sample used 72 ends of 2150 denier and the second sample used 36 ends of 2150 denier. The test was done the same way with the warp yarn in the vertical direction at a 15 degree angle. The bending force in the warp direction is listed below:

| | |
|---|---|
| Sample #1 | 72 ends per inch 2150 stuffer = 154,800 total denier = 2.82 pounds force at a 1" deflection. |
| Sample #2 | 36 ends per inch 2150 stuffer = 77,400 total denier = 1.42 pounds force at a 1" deflection. |

The woven fabric of the present invention is thus characterized by a number of factors that enable this moldability. First is the use of a mono-filament yarn in the filling direction. If moldability is desired in the warp direction there are to be mono-filament yarns in the stuffer weave. Second is the density of the fabric, particularly in the filling direction. This preferably is at least 14 denier and is preferably in a range of 14-10,000 denier. It is also preferred that the fabric be constructed in a dual ply arrangement. For the product to permanently keep its shape, when using nylon or polyester, it is to be exposed to a minimum temperature of 250° F. for at least 5 minutes and preferably more than that even up to 8 hours when using a 2150 polyester monofilament yarn for filling.

Having now described a limited number of embodiment of the present invention, it should now be apparent to those skilled in the art that numerous other embodiments and modifications thereof are contemplated as falling within the scope of the present invention as represented by the appended claims.

What is claimed is:

1. A woven narrow fabric that is characterized by retaining its shape once formed, said woven narrow fabric comprising:

mono-filament filling yarns that are disposed in at least two separate plies including one and another spacedly disposed plies;

the mono-filament filling yarns of the one and another plies being staggered positionally with respect to the one and another plies;

ground yarns that are disposed alternatively over and under adjacent mono-filament filling yarns of respective plies;

said ground yarns including at least a first set that is disposed alternatively over and under adjacent mono-filament filling yarns of only the one ply and a second set that is disposed alternatively over and under adjacent mono-filament filling yarns of only the another ply;

the mono-filament filling yarns of respective plies being of substantially the same density in terms of either the number of yarns per inch or the yarn size;

stuffer yarns that extend in a direction between mono-filament filling yarns of respective plies;

and binder yarns that extend between mono-filament filling yarns of respective plies.

2. The woven fabric of claim 1 wherein said mono-filament filling yarns of respective plies are of substantially the same size in terms of denier.

3. The woven fabric of claim 1 wherein said mono-filament filling yarns are selected from the group that includes nylon, polyester and polypropylene.

4. The woven fabric of claim 1 wherein each mono-filament filling yarn has a yarn size in a range between 14 and 10,000 denier.

5. The woven fabric of claim 1 wherein the density of each mono-filament filling yarn is in a range of 5-100 yarns per inch.

6. The woven fabric of claim 1 wherein said stuffer yarns are also mono-filament yarns.

7. The woven fabric of claim 1 wherein each of said mono-filament filling yarns has a diameter of at least 0.002 inch.

8. The woven fabric of claim 1 wherein said ground yarns are a 20/2 spun polyester.

9. The woven fabric of claim 1 wherein said binder yarns are a 20/2 spun polyester.

10. The woven fabric of claim 1 wherein the density of said monofilament filling yarn is in a range of 10-20 yarns per inch.

11. A woven narrow fabric that is characterized by retaining its shape once formed, said woven narrow fabric comprising:

a plurality of filling yarns that are disposed in at least two separate plies including one and another spacedly disposed plies;

the filling yarns of the one and another plies being staggered positionally with respect to the one and another plies;

a plurality of ground yarns that are disposed alternatively over and under adjacent filling yarns of respective plies;

said ground yarns including at least a first set that is disposed alternatively over and under adjacent filling yarns of the one ply and a second set that is disposed alternatively over and under adjacent filling yarns of the another ply;

one of said filling yarns and ground yarns comprising mono-filament yarns;

the spacing between adjacent filling yarns of the one ply being substantially the same as the spacing between adjacent filling yarns of the another ply;

a plurality of stuffer yarns that extend in a direction between filling yarns of respective plies;

and a plurality of binder yarns that extend between filling yarns of respective plies.

12. The fabric of claim 11 wherein the range of denier of the filling yarns is between 14 denier and 10,000 denier.

13. The fabric of claim 11 wherein the monofilament yarns are from a class of manmade synthetic yarns and said filling yarns comprise mono-filament yarns.

14. The fabric of claim 11 wherein said ground yarns comprise mono-filament yarns.

15. The fabric of claim 11 wherein the stuffer yarns comprise mono-filament yarns.

16. The fabric of claim 11 wherein the picks across the width have a range of 5 per linear inch to 100 per linear inch.

17. The fabric of claim 11 wherein the filling yarns are mono-filament yarns and the minimum density of the monofilament filling yarn is between 5 picks per linear inch using a monofilament yarn having yarn size of 14 denier to 100 picks per inch using a monofilament yarn having a yarn size of 10,000 denier.

18. The fabric of claim 11 wherein the ground yarns have a minimum density of 144 ends per linear inch having a minimum yarn size of 50,000 yards per pound.

19. The fabric of claim 11 wherein each of the filling yarns is a continuous yarn having one side form the one ply and the opposite side form the another ply.

20. The fabric of claim 11 wherein the plurality of binder yarns alternate over and under filling yarns of respective plies.

21. The fabric of claim 11 wherein the plurality of stuffer yarns extend in the same direction as the ground yarns but between the two plies.

22. A woven narrow fabric that is characterized by retaining its shape once formed, said woven narrow fabric comprising:

a plurality of filling yarns that are disposed in at least two separate plies including one and another spacedly disposed plies;

the filling yarns of the one and another plies being staggered positionally with respect to the one and another plies;

a plurality of ground yarns that are disposed alternatively over and under adjacent filling yarns of respective plies;

said ground yarns including at least a first set that is disposed alternatively over and under adjacent filling yarns of only the one ply and a second set that is disposed alternatively over and under adjacent filling yarns of only the another ply;

one of said filling yarns and ground yarns comprising mono-filament yarns;

the filling yarns of respective plies being of substantially the same density in terms of either the number of yarns per inch or the yarn size;

the spacing between adjacent filling yarns of the one ply being substantially the same as the spacing between adjacent filling yarns of the another ply;

a plurality of stuffer yarns that extend in a direction between filling yarns of respective plies;

and a plurality of binder yarns that extend between and alternate over and under filling yarns of respective plies.

23. The fabric of claim 22 wherein each of the filling yarns is a continuous yarn having one side form the one ply and the opposite side form the another ply.

24. The fabric of claim 22 wherein the plurality of binder yarns alternate over and under filling yarns of respective plies and the binder yarns extend over all filling yarns of both one and another plies.

25. The fabric of claim 22 wherein the plurality of stuffer yarns extend in the same direction as the ground yarns but between the two plies.

26. The fabric of claim 22 wherein the staggered positioning of the filling yarns between plies includes positioning each and every filling yarn of the one ply in alignment with a space between adjacent filling yarns of the another ply.

27. The fabric of claim 22 wherein each mono-filament filling yarn has a yarn size in a range between 14 and 10,000 denier.

28. The fabric of claim 22 wherein the density of the monofilament filling yarn is in a range of 5-100 yarns per inch.

29. The fabric of claim 22 wherein the density of said monofilament filling yarn is in a range of 10-20 yarns per inch.

30. The fabric of claim 1 wherein the spacing between adjacent filling yarns of the one ply are substantially the same as the spacing between adjacent filling yarns of the another ply.

31. The fabric of claim 30 wherein the binder yarns extend over all filling yarns of both one and another plies.

32. The fabric of claim 1 wherein the staggered positioning of the filling yarns between plies includes positioning each and every filling yarn of the one ply in alignment with a space between adjacent filling yarns of the another ply.

33. The fabric of claim 11 wherein the mono-filament filling yarns of respective plies are of substantially the same density in terms of the number of yarns per inch.

34. The fabric of claim 11 wherein the density of the monofilament filling yarn is in a range of 5-100 yarns per inch.

35. The fabric of claim 11 wherein the density of said monofilament filling yarn is in a range of 10-20 yarns per inch.

36. The fabric of claim 11 wherein the staggered positioning of the filling yarns between plies includes positioning each and every filling yarn of the one ply in alignment with a space between adjacent filling yarns of the another ply.

* * * * *